United States Patent [19]

Shunsaku

[11] Patent Number: 4,737,132

[45] Date of Patent: Apr. 12, 1988

[54] EYEBALL DEVICE FOR STUFFED TOYS AND DOLLS

[75] Inventor: Ohta Shunsaku, Nishi-Asakusa, Japan

[73] Assignee: Ace Premium Co., Ltd., Tokyo, Japan

[21] Appl. No.: 832,058

[22] Filed: Feb. 24, 1986

[30] Foreign Application Priority Data

Oct. 29, 1985 [JP] Japan ..... 60-166135[U]

[51] Int. Cl.[4] ..... A63H 3/40; A63H 3/38

[52] U.S. Cl. ..... 446/348; 446/346; 446/392

[58] Field of Search ..... 446/341-350, 446/391-393

[56] References Cited

U.S. PATENT DOCUMENTS

| | | | |
|---|---|---|---|
| 2,828,581 | 4/1958 | Prupis | 446/346 |
| 2,856,730 | 10/1958 | Bashover | 446/346 |
| 3,000,136 | 9/1961 | Cohn | 446/346 |
| 3,462,876 | 8/1969 | Kirschenmann | 446/342 X |
| 3,871,128 | 3/1975 | Grooms | 446/372 |

FOREIGN PATENT DOCUMENTS

| | | | |
|---|---|---|---|
| 539374 | 4/1957 | Canada | 446/346 |
| 552490 | 2/1958 | Canada | 446/346 |
| 1248216 | 10/1960 | France | 446/392 |
| 415884 | 11/1946 | Italy | 446/392 |
| 643253 | 7/1962 | Italy | 446/345 |
| 234390 | 5/1925 | United Kingdom | 446/392 |
| 634614 | 3/1950 | United Kingdom | 446/392 |
| 2045095 | 10/1980 | United Kingdom | 446/346 |

*Primary Examiner*—Robert A. Hafer
*Assistant Examiner*—D. N. Muir
*Attorney, Agent, or Firm*—Holman & Stern

[57] ABSTRACT

The invention relates to an eyeball device which can be incorporated as eyes in stuffed toys and dolls. The eyeball device comprises an eyeball-holding assembly which movably holds the eyeball and the pupil of the eye, and a pair of inner and outer members for attaching the eyeball-holding assembly to surrounding portions of eyes of the dolls. The attaching members are fitted to each other so as to bite and hold therebetween the cloth or the surface skin of a doll or the like. The attaching members further have a space for incorporating the eyeball-holding assembly from the outside.

1 Claim, 2 Drawing Sheets

EYEBALL DEVICE FOR STUFFED TOYS AND DOLLS

BACKGROUND OF THE INVENTION

1. Field of the Invention

The present invention relates to an eyeball device for stuffed toys and dolls.

2. Description of the Prior Art

Some of the eyeball devices of this sort express the motion of eyeballs as have been disclosed, for example, in Japanese Utility Model publication Nos. 16924/1958 and 18027/1959. The eyeballs which are movable usually have a complex structure and are bulky, and require particularly designed mounting dents or mounting ports when they are to be mounted in the dolls. The above publications, however, do not teach means for mounting the eyeballs in the dolls. Even at present, the eyeballs are mounted by adhesion or by stitching, requiring cumbersome work. Furthermore, considerable skill is required to neatly or naturally finish the periphery of the eyes. Otherwise, a problem arises in that the adhesive is adhered to the periphery of eyes, or a gap is formed between the eyeball device and the mounting portion.

SUMMARY OF THE INVENTION

The object of the present invention therefore is to provide an eyeball device for stuffed toys and dolls, which enables the eyeballs to be easily mounted in the stuffed toys and dolls and which, further, enables the periphery of the eyeballs to be naturally finished. The eyeball device is equipped with an eyeball-holding frame assembly which movably holds the eyeball, so that the eyeball is allowed to move depending upon the posture and direction of the dolls.

A member for mounting the eyeball-holding frame assembly consists of a pair of inner and outer casing frames which are fitted together to bite the outer cloth of the doll or the like, and is thus mounted very easily. Another object of the present invention is to provide structure in which the outer cloth of the doll or the like is bitten by the inner casing frame and the outer casing frame, so that the inner and outer casings are mounted.

The present invention further provides an eyeball device of the structure in which the inner and outer casing frames, that are mounted as described above, have an outwardly open cavity, respectively, so that the eyeball-holding frame assembly is fitted thereto from the outside. According to the present invention, therefore, there exist no such limitations that the eyeball must be incorporated in advance in the corresponding portions of the doll or the like or that the eyeball-holding frame assembly must be handled together with the inner and outer casing frames as a unitary structure. Namely, the assembling procedure is neatly arranged to markedly increase the assembling operation.

In order to achieve the above-mentioned objects, the present invention deals with the eyeball device of the structure in which an outer cloth of a stuffed toy, doll or the like is bitten by a pair of inner and outer casings which hold an eyeball-holding assembly in which an opening is provided in one side surface of a holding frame, an eyeball body is rotatably supported by a shaft in the opening, and a stabilizer weight is provided in a portion of the eyeball body so that the gaze is stabilized, the improvement wherein an inner casing frame and an outer casing frame are formed in a shape nearly similar to that of the holding frame, a shaft portion is protruded from the rear portion of the holding frame, a cylindrical portion is protruded from the rear portion of the inner casing frame so that the shaft portion of the holding frame is inserted therein, a stop fitting which engages with the rear portion of the outer frame is fitted to the cylindrical portion of the inner frame under the condition where said cylindrical portion is protruded beyond a through hole that is formed in the rear portion of the outer casing frame, and another stop fitting which engages with the rear portion of the inner case is fitted to the shaft portion of the holding frame.

BRIEF DESCRIPTION OF THE DRAWINGS

The drawings illustrate an eyeball device for stuffed toys and dolls according to an embodiment of the present invention, wherein.

DETAILED DESCRIPTION OF THE PREFERRED EMBODIMENT

Figure 1:
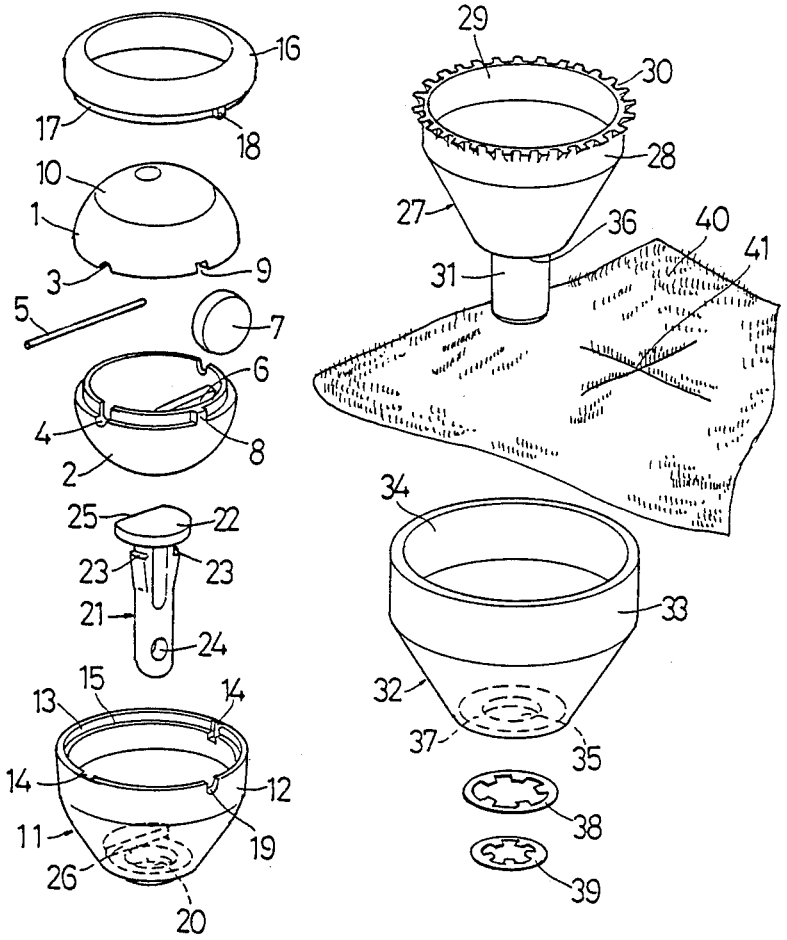
FIG. 1 is a perspective view showing the device in a disassembled manner.
Figure 2:
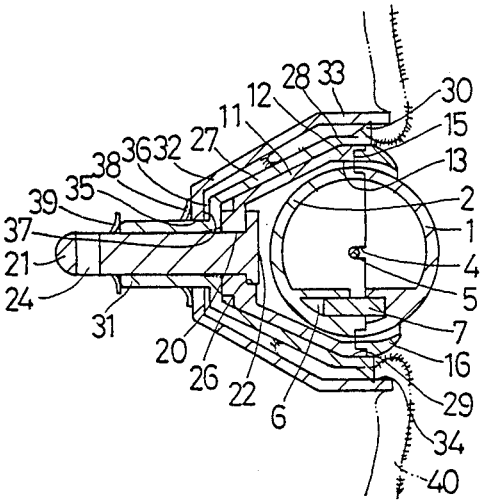
FIG. 2 is a vertical section view showing the device of an assembled condition.

The invention will be described below in detail with reference to an embodiment which is diagrammed. In the drawings, reference numerals 1 and 2 denote semi-spherical eyeball bodies, 3 and 4 denote grooves formed in the joining portions thereof, 5 denotes a shaft which rotatably supports the eyeball bodies, 6 denotes a recessed portion for holding weight formed in one eyeball body, and 7 denotes a stabilizer weight that is held in the recessed portion and that is mounted in position such as just under the shaft 5. Reference numerals 8 and 9 denote a projection and a groove for determining the joining portion of the eyeball bodies 1, 2, and 10 denotes the pupil of the eye.

Reference numeral 11 denotes a holding frame which is formed in a frustoconical shape, which has a ring portion 12 of a large diameter at a portion corresponding to the bottom thereof, and which will hold the above-mentioned eyeball in an opening 13 thereof. Reference numeral 14 denotes grooves for receiving the shaft 5, and 15 denotes a step in the opening with which will engage an inserting end 17 of a circular cover 16. Reference numerals 18 and 19 denote a projection and a groove provided for the cover 16 and a short cylindrical portion 12. Reference numeral 20 denotes a small hole formed in the top portion of the holding frame 11, 21 denotes a shaft portion which is inserted in the small hole 20 and which protrudes beyond the rear portion of the holding frame 11, 22 denotes a protruded head which prevents the shaft portion 21 from escaping, 23 denotes projections that engage with the rear portion of the holding frame, 24 denots a hole for passing a cord or the like, and 25 denotes a turn stop of the shaft portion 21 which engages with the wall 26 of the holding frame 11.

Reference numeral 27 denotes an inner casing frame of a frustoconical shape to which the holding frame 11 is to be fitted, 28 denotes a ring portion of a large diameter, and 29 denotes an opening which has a gear-like biting edge 30 along the outer peripheral edge thereof. Reference numeral 31 denotes a cylindrical portion formed at the top of the inner casing frame 27, and in which the shaft portion 21 of the holding frame 11 is inserted in such a manner that the through hole 24 thereof is protruded beyond the cylindrical portion.

Reference numeral 32 denotes an outer casing frame of a frustoconical shape to which the inner casing frame 27 is to be fitted, 33 denotes a ring portion of a large diameter, 34 denotes an opening, 35 denotes a through hole which is formed in the rear portion (top portion) of the outer casing frame 32, and in which the cylindrical portion 31 of the inner casing frame 27 will be inserted.

The holding frame 11 and the inner casing frame 27 are brought into contact with each other along a conical plane, and the rear end surface 36 of the inner casing frame 27 and the inner surface at the rear end of the outer casing frame 32 are so set that a small gap is maintained therebetween when they are assembled. This permits easy adjustment when the device is fastened to the outer cloth 40. The above-mentioned parts are all made of resin molded products, except the shaft 5 and the weight 7. Reference numeral 38 denotes a stop fitting fitted to the cylindrical portion 31 of the inner casing frame 27, 39 denotes a small stop fitting fitted to the shaft portion 21 of the holding frame 11, and 41 denotes a cross-shaped slit formed in the outer cloth 40 to attach the eyeball.

In the above-mentioned structure, the shaft portion 21 is mounted on the holding frame 11, an eyeball which is assembled together with the stabilizer weight 7 is rotatably mounted thereon using the shaft 5, and the cover 16 is adhered thereto to form an eyeball-holding assembly. The inner casing frame 27 is inserted in the slit 41 of the outer cloth 40 from the front side, and the outer casing frame 32 is fitted thereto from the back side. Then, the inner casing frame 27 and the outer casing frame 32 are fitted together in such a manner that the outer cloth 40 is bitten therebetween; i.e., the outer cloth 40 is reliably fastened owing to the protruded edge 30, and the stop fitting 38 is fitted to the cylindrical portion 31. The eyeball-holding assembly may have been incorporated in the inner casing frame 27 in advance as a unitary structure, or may be fitted thereinto from the outside after the assembling operation is finished up to this step. Here, the small stop fitting 39 may be smaller than the diameter of the through hole 35. In this case, the holding frame 11 is mounted in the inner casing frame 27 as a unitary structure. A gap is maintained between the rear end surface 36 of the inner casing frame 27 and the inner surface 37 at the rear end of the outer casing frame 32 under the assembled condition. Further, the biting edge 30 is movable toward the inner and the outer directions along the inner surface of the ring portion 33 have large diameter of the outer casing frame 32. Therefore, if there is no margin in the boundary between the outer cloth 40 and the eyeball, the outer casing frame 32 should be pulled out. When it is desired to give tension to the outer cloth 40, on the other hand, the outer casing frame 32 should be pushed in. The stop fitting 38 should be stopped at such a position that a desired relation is obtained.

What is claimed is:

1. An eyeball device for stuffed toys and dolls comprising a pair of hemispherical eyeball bodies have grooved joining portions for interconnecting the bodies to form an eyeball, a research portion formed in one of the eyeball bodies for holding a weight, and a stabilizer weight provided in the recessed portion, a holding frame having a cylindrical portion for receiving the eyeball therein, a shaft for rotatably supporting the eyeball in the cylindrical portion of the holding frame, the holding frame having a frustoconical rear portion, a shaft portion extending from the rear portion of the holding frame, inner and outer casing frames shaped in substantial conformity to the holding frame, the inner casing frame having a cylindrical portion extending from a frustoconical rear portion thereof for receipt of the shaft portion of the holding frame therethrough, the cylindrical portion of the inner casing frame being insertable through an opening in a back wall of the outer frame, a first stop ring for engaging over the cylindrical portion of the inner casing frame and preventing the inner casing frame from being removed from the outer casing frame, a second stop ring for engaging around the shaft portion against the cylindrical portion to prevent the holding frame from being removed from the inner casing frame, and cooperating gripping means internally of the outer casing frame and externally of the inner casing frame for gripping cloth forming an eyeball surround therebetween.

* * * * *

UNITED STATES PATENT AND TRADEMARK OFFICE

CERTIFICATE OF CORRECTION

PATENT NO. : 4,737,132

DATED : Apr. 12, 1988

INVENTOR(S) : Ohta Shunsaku

It is certified that error appears in the above-identified patent and that said Letters Patent is hereby corrected as shown below:

On the title page Item [73] should read

-- [73] Assignee: Ace Premium Co., Ltd., Tokyo, Japan and Sekiguchi Creative House Co., Ltd. Tokyo, Japan --.

Signed and Sealed this

Sixth Day of December, 1988

*Attest:*

DONALD J. QUIGG

*Attesting Officer*

*Commissioner of Patents and Trademarks*